US008726655B2

(12) United States Patent
Smatloch et al.

(10) Patent No.: US 8,726,655 B2
(45) Date of Patent: May 20, 2014

(54) MODULAR EXHAUST GAS ASSEMBLY

(75) Inventors: Christian Smatloch, Paderborn (DE); Elmar Grussmann, Altenbeken (DE); Frank Arlt, Hövelhof (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 521 days.

(21) Appl. No.: 13/013,255

(22) Filed: Jan. 25, 2011

(65) Prior Publication Data

US 2012/0023928 A1 Feb. 2, 2012

(30) Foreign Application Priority Data

Jan. 25, 2010 (DE) ..... 10 2010 005 761

(51) Int. Cl.

| | |
|---|---|
| ***F02D 23/00*** | (2006.01) |
| *F04D 29/44* | (2006.01) |
| *F04D 29/54* | (2006.01) |
| *B21K 19/00* | (2006.01) |

(52) U.S. Cl.

USPC ..... 60/602; 415/204; 415/205; 415/912; 29/889.2

(58) Field of Classification Search

USPC ..... 415/204, 912

See application file for complete search history.

(56) References Cited

U.S. PATENT DOCUMENTS

| | | | | |
|---|---|---|---|---|
| 6,519,936 | B2 | 2/2003 | Smatloch et al. | |
| 6,687,996 | B2 | 2/2004 | Smatloch et al. | |
| 6,708,485 | B2 | 3/2004 | Hinder et al. | |
| 6,910,506 | B2 | 6/2005 | Gabriel et al. | |
| 7,185,490 | B2 | 3/2007 | Smatloch et al. | |
| 7,198,459 | B2 * | 4/2007 | Grussmann et al. | 415/135 |
| 7,581,563 | B2 | 9/2009 | Smatloch | |
| 7,946,116 | B2 * | 5/2011 | Sausse et al. | 60/602 |
| 8,382,429 | B2 * | 2/2013 | Grussmann et al. | 415/213.1 |
| 2005/0126163 | A1 * | 6/2005 | Bjornsson, Sr. | 60/323 |
| 2008/0202117 | A1 | 8/2008 | Leroy | |
| 2009/0188747 | A1 | 7/2009 | Smatloch et al. | |
| 2009/0288404 | A1 | 11/2009 | Lempa et al. | |
| 2010/0098533 | A1 * | 4/2010 | Grussmann et al. | 415/203 |

(Continued)

FOREIGN PATENT DOCUMENTS

| | | |
|---|---|---|
| DE | 100 22 052 A1 | 1/2001 |
| DE | 100 29 807 C1 | 3/2002 |

(Continued)

OTHER PUBLICATIONS

DE 10050158 A1 English Translation.*

*Primary Examiner* — Thomas Denion
*Assistant Examiner* — Jessica Kebea
(74) *Attorney, Agent, or Firm* — Henry M Feiereisen LLC

(57) ABSTRACT

A modular exhaust gas assembly includes a turbocharger housing having an exhaust flange and a bearing flange receptacle, and a plurality of turbine scrolls of different sizes for selective installation into the turbocharger housing in dependence on a power of an engine. Each turbine scroll has an inlet zone and is connected to the bearing flange receptacle via a selected one of a plurality of different bearing flanges and to the exhaust flange via a selected one of a plurality of different exhaust links. The inlet zone of each turbine scroll is configured to complement a contour of an outlet zone of a standard manifold so that the turbine scrolls are selectively connectable via their inlet zone to the manifold to suit the engine power at hand.

18 Claims, 3 Drawing Sheets

(56) References Cited

U.S. PATENT DOCUMENTS

| | | | | |
|---|---|---|---|---|
| 2010/0180592 | A1* | 7/2010 | Williams et al. | 60/602 |
| 2010/0310364 | A1* | 12/2010 | Botsch et al. | 415/212.1 |
| 2010/0316494 | A1* | 12/2010 | Gru mann et al. | 415/231 |
| 2011/0091318 | A1* | 4/2011 | Kratschmer et al. | 415/205 |
| 2011/0198820 | A1* | 8/2011 | Janzen et al. | 280/124.106 |
| 2011/0318177 | A1* | 12/2011 | Botsch et al. | 415/208.1 |
| 2012/0251315 | A1* | 10/2012 | Watanabe et al. | 415/212.1 |
| 2013/0064655 | A1* | 3/2013 | Smatloch et al. | 415/182.1 |
| 2013/0064656 | A1* | 3/2013 | Smatloch et al. | 415/182.1 |

FOREIGN PATENT DOCUMENTS

| | | | |
|---|---|---|---|
| DE | 10050158 | A1 * | 4/2002 |
| DE | 103 07 028 | B3 | 5/2004 |
| DE | 603 12 535 | T2 | 6/2005 |
| DE | 102008032492 | A1 | 1/2010 |
| JP | 2002349275 | | 12/2002 |
| JP | 2004183651 | | 7/2004 |
| JP | 2007002791 | | 1/2007 |
| JP | 2007278130 | | 10/2007 |

* cited by examiner

MODULAR EXHAUST GAS ASSEMBLY

CROSS-REFERENCES TO RELATED APPLICATIONS

This application claims the priority of German Patent Application, Serial No. 10 2010 005 761.4-13, filed Jan. 25, 2010, pursuant to 35 U.S.C. 119(a)-(d), the content of which is incorporated herein by reference in its entirety as if fully set forth herein.

BACKGROUND OF THE INVENTION

The present invention relates to a modular exhaust gas assembly.

The following discussion of related art is provided to assist the reader in understanding the advantages of the invention, and is not to be construed as an admission that this related art is prior art to this invention.

Internal combustion engines are increasingly charged using turbochargers in order effectively reduce fuel consumption. On the basis of a few base engines, the engine control can be suited to variations of different vehicles. The turbocharger, in particular the cast turbine housing, can be suited very accurately to the power characteristic of the respective engine in order to realize an effective operation. However, costs to implement and adjust turbochargers in sheet metal construction are very high as far as forming tools and devices are concerned so that the use of adjustable turbochargers in sheet metal construction becomes economical only when car models are involved that are produced on a large scale.

These drawbacks are also encountered, when cast manifolds and turbocharger housings are involved because each power stage or engine power variation of a combustion engine requires a newly reconfigured manifold and turbocharger housing and also a renewed execution of all validation activities. This results in added costs for development, tools and devices because the individual components of the turbocharger have to be adjusted to one another and checked with respect to their interactions. In addition, the adjacent engine periphery must be suited to the different components of the turbocharger, further increasing costs.

German Pat. No. DE 100 29 807 C1 discloses an approach to address costs concerns by keeping the number of turbines to a minimum in order to suit varying engine types. To realize different engine throughputs in dependence on the engine size, the standard turbines have to be modified to suit the respective type by grinding down the outer wheel contour of the turbine wheel to smaller radii. However, in order to keep the gap constant between the outer wheel contour and the contour sleeve which embraces the turbine wheel, the contour sleeve must be refinished as well. These measures are relatively complex.

It would therefore be desirable and advantageous to provide an improved exhaust gas turbocharger which obviates prior art shortcomings and which can be best suited to various designs and power outputs of an internal combustion engine in a cost-efficient manner while still being reliable in operation.

SUMMARY OF THE INVENTION

According to one aspect of the present invention, a modular exhaust gas assembly includes a turbocharger housing having an exhaust flange and a bearing flange receptacle, and a plurality of turbine scrolls of different sizes for selective installation into the turbocharger housing in dependence on a power of an engine, with each turbine scroll having an inlet zone and being connected to the bearing flange receptacle via a selected one of a plurality of different bearing flanges and to the exhaust flange via a selected one of a plurality of different exhaust links, wherein the inlet zone of each turbine scroll is configured to complement a contour of an outlet zone of a standard manifold so that the turbine scrolls are selectively connectable via their inlet zone to the manifold to suit the engine power at hand.

The present invention resolves prior art problems by providing the exhaust gas assembly with a turbocharger housing which is provided with a standard exhaust flange and a standard bearing flange receptacle. Any one of the plurality of turbine scrolls of different size or shape can be installed into the turbocharger housing and connected to the bearing flange receptacle via an appropriate bearing flange and to the exhaust flange via an appropriate exhaust link. The attachment zone for the inlet zone of the turbine scroll is also standardized so that any one of the selected turbine scrolls can be connected to the attachment zone of the manifold. As a result, different engine powers can be accommodated by using the appropriate turbine scroll for connection of the inlet zone thereof to the manifold.

Thus, the present invention provides a modular system which allows the use of standard components of the manifold housing and of the turbocharger housing for engines of varying power stages by selecting the one turbine scroll and/or bearing flange that is/are best suited for the demanded power stage at hand. All attachment zones of the various turbine scrolls and/or bearing flanges are the same and suited to the standard manifold housing and turbocharger housing for attachment. The modular system according to the present invention uses standard base components, represented by the manifold housing and the turbocharger housing, which can be combined with different turbine scrolls.

According to another advantageous feature of the present invention, the turbocharger housing may be formed in one piece with the manifold housing. For example, the turbocharger housing can be welded to the manifold housing.

According to another advantageous feature of the present invention, the turbine scroll has an outlet zone which can be coupled to the exhaust link via a sliding seat. Suitably, the exhaust link is configured to embrace a tubular neck of the exhaust flange radially on the outside.

According to another advantageous feature of the present invention, the exhaust link may be provided in a contact zone with the turbine scroll with a collar which is directed radially inwards. The collar of the exhaust link has an end region which can be bent in a direction of the exhaust flange. As a result, a radially inwardly directed surface of the bent end region is able to flatly rest upon the outer side of the attachment zone of the turbine scroll.

The radial and axial distances between an outer side of the exhaust link and the tubular neck of the exhaust flange varies depending on the size of the exhaust flange to which the exhaust link is secured. Using exhaust links of different configuration to suit the size of the turbine scroll enables a linkage between the standard exhaust flange of the turbocharger housing and the turbine scroll. Suitably the exhaust link is connected by a material joint with the tubular neck of the exhaust flange. For example, the material joint may be realized through welding.

According to another advantageous feature of the present invention, the end region of the collar can be provided with an annular groove for receiving a sealing element to provide a seal between an attachment zone of the turbine scroll and the exhaust link.

According to another advantageous feature of the present invention, the exhaust link can be provided with a bellows to compensate a change in length between the turbine scroll and the exhaust flange. As a result, the exhaust link can have different diameters to connect the turbine scroll with the exhaust flange.

As described above, the turbine scroll is connected via a bearing flange with the standard bearing flange receptacle. The bearing flange can hereby be provided with a base body and an outer circumferential collar which surrounds the base body of the bearing flange. The collars of the various bearing flanges have different widths to suit the engine power at hand and to bear flatly upon the outer side of the turbocharger housing in the area of the bearing flange receptacle. As a result, the collar of the bearing flange can be connected by a material joint, e.g. welded, to the bearing flange receptacle. The collars of the bearing flanges thus have a same outer diameter, whereas the inner diameter thereof depends on the size of the base body. The collar of the bearing flange may be a single-piece component of the base body.

The manifold housing and the turbocharger housing are configured for highest engine power. Suitably, the housings of the manifold and turbocharger are made from one or more sheet metal parts. The housings of the manifold and turbocharger are also additionally dimensioned for highest exhaust temperature. As a result, the exhaust gas assembly according to the invention is applicable for all possible engine power stages. Coupling of engine and manifold housings may also be realized via an adapter or intermediate piece.

The turbocharger housing may also be secured to the engine having a cylinder head and a manifold integrated in the cylinder head. The turbocharger housing can hereby have a flange for attachment to the cylinder head. The exhaust-carrying components inside the turbocharger housing are suited to the respective power classification of the engine. The flange is a standard component that is provided for different power stages. The inlet zone of the turbine scroll projects beyond the flange of the turbocharger housing in a direction of the manifold. The flow dynamics can be enhanced when providing the outlet zone of the manifold with a groove which points to the flange of the turbocharger housing for engagement of an end of the inlet zone of the turbine scroll. The groove is thus positioned at a distance from the flow channels and does not cause an increase in diameter of the outlet zone. Rather, the groove surrounds the outlet zone at a predefined distance.

As an alternative, the outlet zone of the manifold can be connected with the inlet zone of the turbine scroll by providing the end of the outlet zone of the manifold with a recess in the form of a circumferential depression in which the inlet zone of the turbine scroll engages. This is easier to manufacture compared to a manufacture of a separate groove.

The housing of the exhaust gas assembly may be composed of several shells. In shell construction, upper and lower shells are provided, whereby the upper and lower shells may form part of the manifold housing as well as part of the turbocharger housing.

An exhaust gas assembly according to the present invention has many advantages. Costs for tools and devices with respect to the manifold housing and the turbocharger housing can be spread over a significantly greater production quantity, resulting in a decrease in the unit price. Fewer components need to be newly developed and tested. This leads to shorter development times and reduced costs. Moreover, connection elements and the engine periphery can be suited to one and the same turbocharger housing and manifold housing so that the need for alterations is eliminated. Space requirements remain the same and the exhaust gas assembly can easily be conformed to different engine variations, for example by changing the material and geometry of the internal system. Furthermore, overall costs for the production of the exhaust gas assembly can be reduced because standard vehicle tests, such as, e.g., crash tests, need to be performed only for one variation.

Factors which impact the material selection and geometry of the internal system includes:

- exhaust mass flow (and thus directly the engine power);
- exhaust temperatures which basically can be selected as high as permitted for the used materials;
- vibrations;
- rotation speed limits for the moving parts;
- combinations of the afore-stated factors.

A possible configuration of an exhaust gas assembly according to the present invention thus contemplates different materials for the internal system. For example, when four different engine powers are involved, ferritic high-quality steels, such as, e.g., steel with 18% chromium by weight and fractions of niobium and titanium, can be used for the smallest engine power for stabilization. An example of a suitable steel is a steel of grade X2CrTiNb18 with the material number 1.4509.

For the next higher power classification, austenitic high-quality steels can be used. Examples include steel with, in weight percent, about 20% of chromium and 12% of nickel, such as X15CrNiSi20 12 with material number 1.4828.

For a further increase in power, austenitic high-temperature nickel-iron-chromium mixed crystal alloys with controlled contents of carbon, aluminum and titanium can be used. These alloys have high metallic stability when used over an extended time even at high temperatures. An example of a suitable steel is steel alloy X10NiCrAlTi32 20 with material number 1.4876.

In the range of very high motor outputs, nickel-based alloys can be used having, in weight percent, about 60% of nickel, 20% of chromium, and 15% of iron. A nickel-chromium alloy with material number 2.4851, also commercially available with the designation "Inconel 601®" (Inconel is a trademark of Special Metals Corporation, USA), has great resistance to oxidation and other forms of high-temperature corrosion.

An example for the use of materials for various power stages of a four-cylinder engine can be selected as follows:

| | |
|---|---|
| 1.9 l engine capacity, 220 kW: | Inconel 601 ® |
| 1.9 l engine capacity, 183 kW: | 1.4876 |
| 1.9 l engine capacity, 147 kW: | 1.4828 |
| 1.7 l engine capacity, 125 kW: | 1.4509 |

The basis for the selection of the respective external system (outer shells) is the engine with greatest power. Less powerful engines require only adjustment of the internal system. Thus, the external system is the same in all engine variants.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figures 1, 1A, 1B:
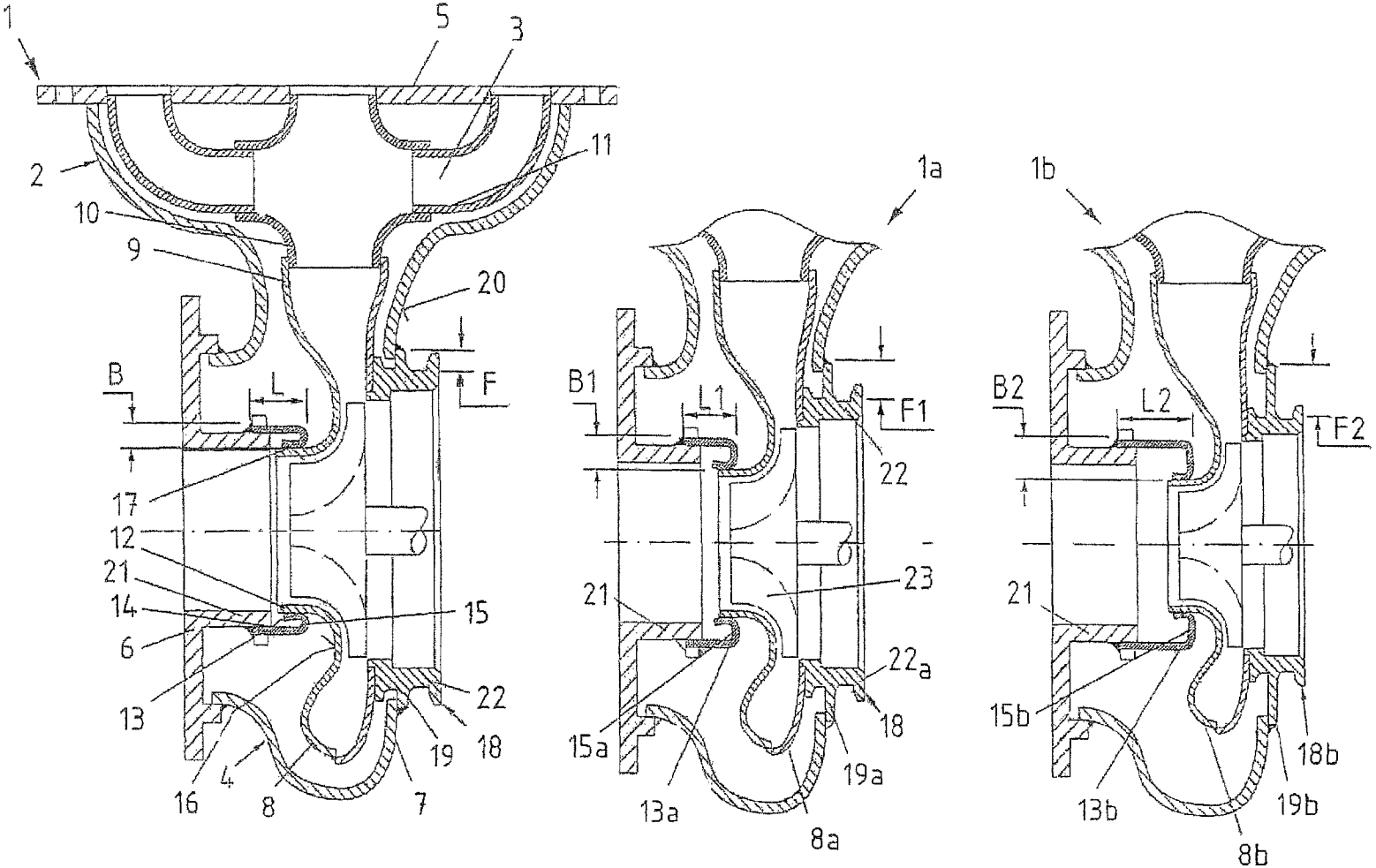
FIGS. 1, 1*a*, 1*b* are sectional views of a modular exhaust gas assembly according to the present invention respectively modified to suit different engine powers.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a sectional view of a modular exhaust gas assembly according to the present invention, generally designated by reference numeral 1. The exhaust gas assembly 1 includes a turbocharger housing 4, generally designated by reference numeral 4 and formed in one piece with a manifold housing 2 of a manifold 3. An adapter having a connection zone 5 secures the turbocharger housing 4 with the manifold housing 2 to an internal combustion engine. The connection zone 5, an exhaust flange 6 of the turbocharger housing 4, and a bearing flange receptacle 7 of the turbocharger housing 4 are all standard components. In other words, the dimensions for connections do not vary, even when the internal system of the exhaust gas assembly 1 changes, as a comparison with FIGS. 1*a*, 1*b* shows which depict modified internal systems of the exhaust gas assembly 1 to suit different engine powers.

In the exhaust gas assembly 1, a turbine scroll 8 is selected which has an inlet zone 9 in conformity with a standard outlet zone 10 of a manifold internal system 11. An outlet zone 12 of the turbine scroll 8 is coupled via an exhaust link 13 with the exhaust flange 6 of the turbocharger housing 4. The exhaust link 13 embraces an outer side of a tubular neck 21 of the exhaust flange 6 and thus bears with its inner circumferential side 14 flatly upon the tubular neck 21 and can be connected thereto by a material joint. As shown by way of example in FIG. 1, the exhaust link 13 is welded to the neck 21.

The exhaust link 13 has an end region which points towards the turbine scroll 8 to form a radially inwardly directed collar 15 whose end is bent in the direction of the exhaust flange 6. As a result, an outer side 16 of the outlet zone 12 of the turbine scroll 8 bears flatly on an inner surface 17 of the collar 15 to support the inner surface 17. The radially inwardly directed region of the collar 15 is defined by a width B and a length L which depend on the configuration of the turbine scroll 8.

The bearing flange receptacle 7 receives a bearing flange 18 which connects the turbine scroll 8 to the turbocharger housing 4. The turbine scroll 8 and the bearing flange 18 have a geometry which complements one another and is suited to the motor power. The bearing flange 18 has a base body 22 and a circumferential collar 19 which projects out from the base body 22 at a width F and rests on an outer side 20 of the bearing flange receptacle 7 of the turbocharger housing 4 and which is connected to the outer side 20. The circumferential collar 19 is connected to the outer side 20 by a material joint, e.g. by welding, as shown by way of example in FIG. 1.

The manifold housing 2 and the turbocharger housing 4 are configured in this case for a maximally possible motor power of the connected internal combustion engine.

FIG. 1*a* shows an exhaust gas assembly, generally designated by reference numeral 1*a* and configured for a lesser engine power by selecting a turbine scroll 8*a* which suits the lesser engine power. In the following description, parts corresponding with those in FIG. 1 will be identified, where appropriate for the understanding of the invention, by corresponding reference numerals followed by an "a". The turbine scroll 8*a* is coupled with the exhaust flange 6 of the turbocharger housing 4 via an exhaust link 13*a*. As shown in FIG. 1*a*, the exhaust link 13*a* has a collar 15*a* with a radially inwardly directed region which is defined by a width B1 which is greater than the width B of the radially inwardly directed region of the collar 15 of the exhaust link 13 of the exhaust gas assembly 1 of FIG. 1, and defined by a length L1 which is smaller than the width L of the radially inwardly directed region of the collar 15. Thus, the turbine scrolls 8, 8*a* have different configurations and can be coupled to the exhaust flange 6 via complementary exhaust links 13, 13*a*, respectively.

A bearing flange 18*a* for a turbocharger wheel 23 is connected to the turbine scroll 8*a* and has a base body 22*a* of smaller size than the base body 22 of the bearing flange 18, and a circumferential collar 19*a* projecting out from the base body 22*a*. The connection of the bearing flange 18*a* with the turbocharger housing 4 is rendered possible by providing the circumferential collar 19*a* of the bearing flange 18*a* with a width F1 which is greater than the width F of the circumferential collar 19 of the bearing flange 18. Thus, the bearing flange 18*a*, which is configured for a lesser motor power, can bear upon the outer side 20 of the standard bearing flange receptacle 7 and can be connected thereto by a material joint.

FIG. 1*b* shows an exhaust gas assembly, generally designated by reference numeral 1*b* and configured for an even further reduced engine power by selecting a turbine scroll 8*b* which is selected for this engine power. In the following description, parts corresponding with those in FIG. 1 will be identified, where appropriate for the understanding of the invention, by corresponding reference numerals followed by an "b". In this variation, the exhaust link 13*b* has a collar 15*b* with a radially inwardly directed region which is defined by a width B2 which is greater than the widths B and B1, shown in the variants of FIGS. 1 and 1*b*, respectively. The length L2 of the radially inwardly directed region of the collar 15*b* is hereby sized longer than the lengths L and L1 of the radially inwardly directed regions of the collars 15, 15*a*, respectively, so that despite a same size of the turbocharger housing 4 and of the exhaust flange 6, the installation of turbine scroll 8*b* is possible for use with the involved further reduced engine power.

The bearing flange 18*b*, coupled with the turbine scroll 8*b*, is also configured for the same engine power as is the turbine scroll 8*b* and includes a collar 19*b* which has a width F2 that is greater than the widths F, F1 of the circumferential collars 19, 19*a* of the bearing flanges 18, 18, respectively. Like in the afore-described variants of FIGS. 1 and 1*a*, the collar 19*b* bears on the outer side 20 of the standard bearing flange receptacle 7 and is connected thereto by a material joint.

In all afore-described variations of an exhaust gas assembly 1, 1*a*, 1*b* according to the present invention, the outer diameter of the collars 19, 19*a*, 19*b* is identical, whereas their inner diameter changes. The turbocharger housing 4 and the manifold housing 2, which are only hinted in FIGS. 1*a* and 1*b*, are identical in all variants. Also the size of the exhaust flange 6, the bearing flange receptacle 7, and the connection of the manifold 3 are standardized.

The exhaust gas assemblies 1, 1*a*, 1*b* are shown by way of example for application when the engine power is different. The description makes clear which parts of the modular system are standard and which parts vary. The outer structure of the manifold housing 2 and the turbocharger housing 4 with the exhaust flange 6 remains basically unchanged. The inside of the exhaust gas assembly 1, 1*a*, 1*b* on the other hand can be modified to meet the engine power at hand by selecting an appropriate one of the available turbine scrolls 8, 8*a*, 8*b* of different configurations and selecting an appropriate one of the associated exhaust links 13, 13*a*, 13*b* for respective connection of the turbine scrolls 8, 8*a*, 8*b* to the exhaust flange 6.

On the side of the turbocharger housing 4 in opposition to the exhaust flange 6, the bearing flange 18, 18*a*, 18*b* is configured for the turbine wheel 23 to have a standardized outer dimension which fits the standardized turbocharger housing 4. Common to all variants is also that the inlet zone 9 of the turbine scrolls 8, 8*a*, 8*b* is configured to complement the configuration of the manifold 3, regardless of the difference in configuration between the turbine scrolls 8, 8*a*, 8*b*. Although not shown in the figures, the manifold inner system 11 may, of course, also be modified to realize a still further adjustment to varying engine powers.

Figure 2A:
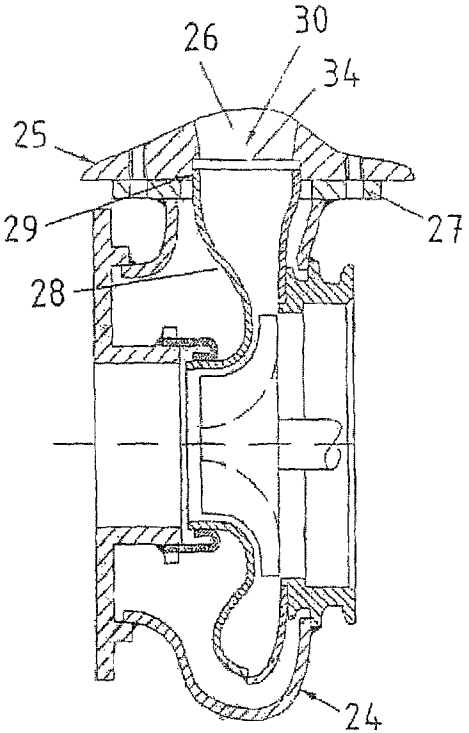
FIG. 2*a* is a sectional view of a second embodiment of a connection between a turbocharger housing and an engine with integrated manifold.
Figure 2:
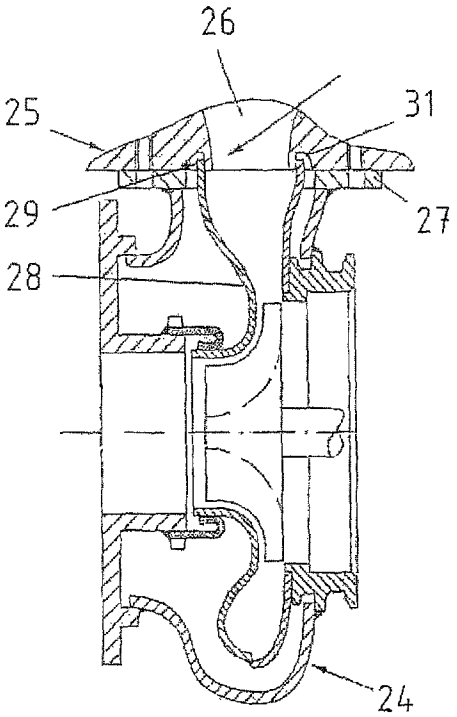
FIG. 2 is a sectional view of a first embodiment of a connection between a turbocharger housing and an engine with integrated manifold.

Referring now to FIG. 2, there is shown a sectional view of a first embodiment of a connection of a turbocharger housing, generally designated by reference numeral 24, to an engine with integrated manifold 26. As shown in FIG. 2, the turbocharger housing 24 is directly connected to a cylinder head 25 of the engine. The turbocharger housing 24 has a flange 27 for securing the turbocharger housing 24 to the cylinder head 25. The exhaust-carrying components inside the turbocharger housing 24, such as, e.g., a turbine scroll 28, as described in connection with FIGS. 1, 1*b*, 1*b*, are suited to the respective power classification of power stage of the engine at hand, in a manner described with reference to FIGS. 1, 1*a*, 1*b* and thus not explained again.

The attachment of the turbocharger housing 24 is realized via a flange 27 which is the same for all different power stages of the engine or all exhaust gas assemblies. An inlet zone 29 of the turbine scroll 28 is sized to project beyond the flange 27 in a direction of the cylinder head 25. As shown in FIG. 2, the manifold 26 has an outlet zone 30 which is provided with a circumferential groove 31 which points in a direction of the turbocharger housing 24 for engagement of an end of the inlet zone 29 of the turbine scroll 28. Thus, groove 31 wraps around the outlet zone 30 of the manifold 26.

FIG. 2*a* shows a sectional view of a second embodiment of a connection between the turbocharger housing 24 and the manifold 26. Parts corresponding with those in FIG. 2 are denoted by identical reference numerals and not explained again. The description below will center on the differences between the embodiments. In this embodiment, provision is made for a recess 34 or clearance, instead of a groove, in the outlet zone 30 of the manifold 32 for engagement of the end of the inlet zone 29 of the turbine scroll 28.

Figure 3:
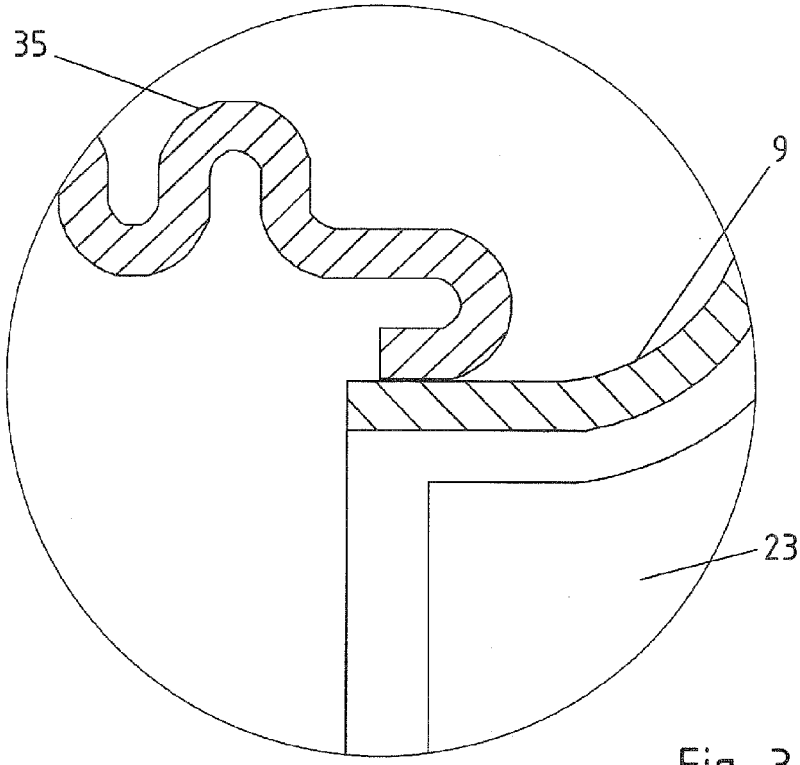
FIG. 3 is an enlarged detailed view of a variation of an exhaust link in an attachment with a turbine scroll.

Referring now to FIG. 3, there is shown an enlarged detailed view of a variation of an exhaust link 13, 13*a*, 13*b* in an attachment with turbine scroll 8, 8*a*, 8*b*. In this embodiment, the exhaust link 13, 13*a*, 13*b* is provided with a bellows 35 to compensate a change in length between the turbine scroll 8, 8*a*, 8*b* and the exhaust flange 6.

Figure 3A:
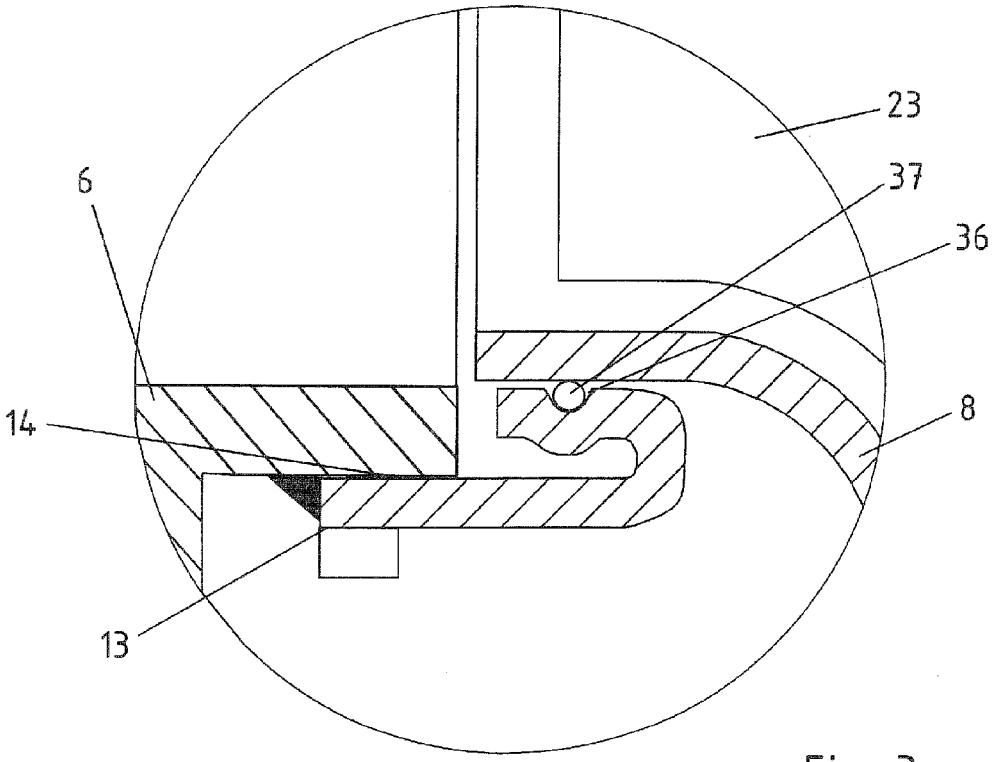
FIG. 3*a* is an enlarged detailed view of another variation of an exhaust link in an attachment with a turbine scroll.
Figure 1B:
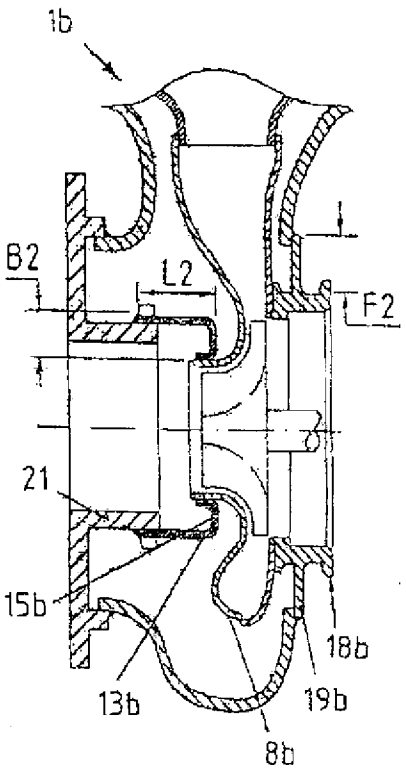
Figure 1A:
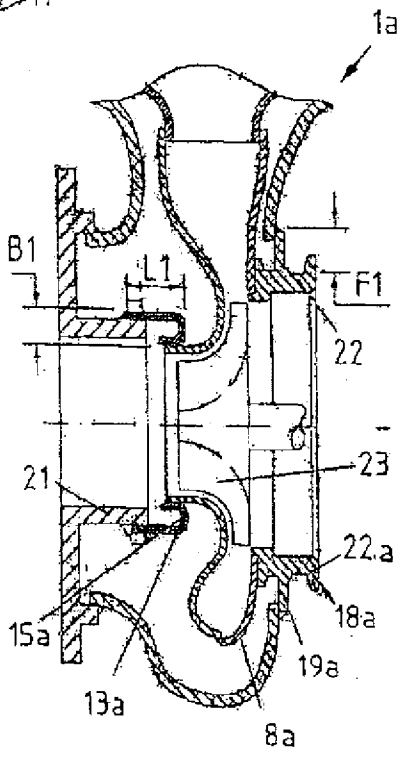
Figure 1:
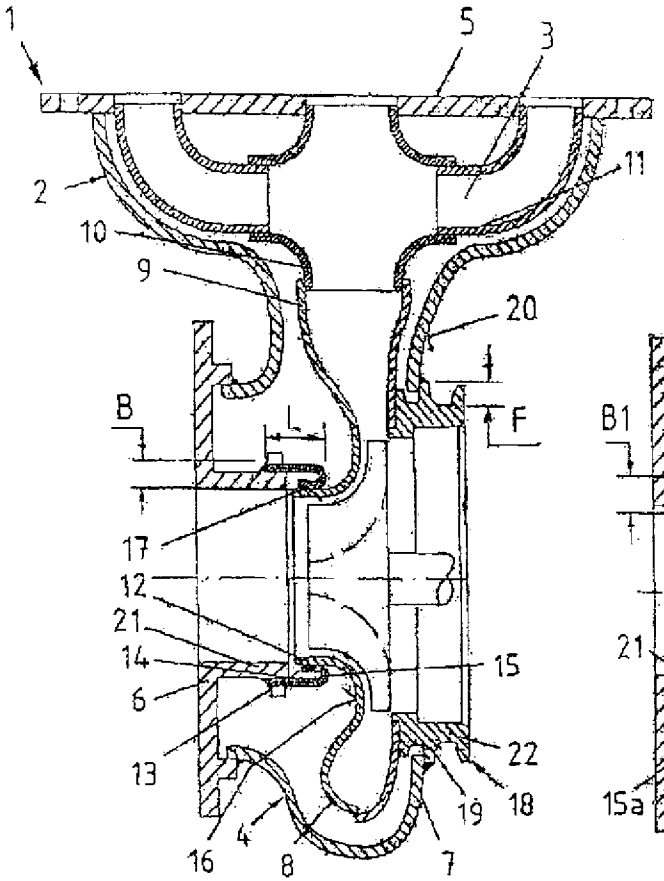

FIG. 3*a* shows an enlarged detailed view of still another variation of an exhaust link 13 in an attachment with turbine scroll 8. In this embodiment, the end region of the collar 15 of the exhaust link 13 is provided with an annular groove 36 for receiving a sealing element 37 to provide a seal between an attachment zone of the turbine scroll 8 and the exhaust link 13.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A modular exhaust gas assembly, comprising:

a turbocharger housing having an exhaust flange and a bearing flange receptacle;

a plurality of turbine scrolls of different sizes for selective installation into the turbocharger housing in dependence on a power of an engine, each said turbine scroll having an inlet zone;

a plurality of different bearing flanges; and a plurality of different exhaust links, wherein each of said turbine scrolls is connected to the bearing flange receptacle via a selected one of the plurality of different bearing flanges and to the exhaust flange via a selected one of the plurality of different exhaust links, wherein the inlet zone of each said turbine scroll is configured to complement a contour of an outlet zone of a standard manifold so that the turbine scrolls of different sizes are selectively connectable via their inlet zone to the manifold to suit the engine power at hand.

2. The exhaust gas assembly of claim 1, wherein the turbocharger housing is formed in one piece with a housing of the manifold.

3. The exhaust gas assembly of claim 1, wherein the turbocharger housing is welded to the manifold housing.

4. The exhaust gas assembly of claim 1, wherein the turbine scroll has an outlet zone which is coupled to the exhaust link via a sliding seat.

5. The exhaust gas assembly of claim 1, wherein the bearing flange is constructed to complement a configuration of the turbine scroll.

6. The exhaust gas assembly of claim 1, wherein the bearing flanges have a same outer diameter and are formed with collars of different widths for bearing upon an outer side of the bearing flange receptacle.

7. The exhaust gas assembly of claim 1, wherein the exhaust link is sized to embrace a tubular neck of the exhaust flange.

8. The exhaust gas assembly of claim 1, wherein the exhaust link is provided with a collar which is directed radially inwards.

9. The exhaust gas assembly of claim 8, wherein the collar of the exhaust link has an end region which is bent in a direction of the exhaust flange.

10. The exhaust gas assembly of claim 9, wherein the end region of the collar is provided with an annular groove for receiving a sealing element to provide a seal between an attachment zone of the turbine scroll and the exhaust link.

11. The exhaust gas assembly of claim 1, wherein the exhaust link is provided with a bellows to compensate a change in length between the turbine scroll and the exhaust flange.

12. The exhaust gas assembly of claim 1, wherein the exhaust link is connected with the exhaust flange by a material joint.

13. The exhaust gas assembly of claim 1, wherein the exhaust link is welded to the exhaust flange.

14. The exhaust gas assembly of claim 1, wherein the turbocharger housing and the manifold housing are made from one or more sheet metal parts.

15. The exhaust gas assembly of claim 1, further comprising an adapter for securing the turbocharger housing with the manifold housing to the engine.

16. The exhaust gas assembly of claim 1, wherein the turbocharger housing is secured to the engine having a cylinder head, with the manifold integrated in the cylinder head.

17. The exhaust gas assembly of claim 1, wherein the outlet zone of the manifold is provided with a groove for engagement of the inlet zone of the turbine scroll.

18. The exhaust gas assembly of claim 1, wherein the outlet zone of the manifold is provided with a recess in the form of a circumferential depression for engagement of the inlet zone of the turbine scroll.

* * * * *

UNITED STATES PATENT AND TRADEMARK OFFICE

CERTIFICATE OF CORRECTION

PATENT NO. : 8,726,655 B2
APPLICATION NO. : 13/013255
DATED : May 20, 2014
INVENTOR(S) : Smatloch et al.

It is certified that error appears in the above-identified patent and that said Letters Patent is hereby corrected as shown below:

The title page showing the illustrative figure should be deleted to be replaced with the attached title page.

In the Drawings

Drawing sheet, consisting of Figs. 1, 1a and 1b, should be deleted to be replaced with the drawing sheet, consisting of Figs. 1, 1a and 1b, as shown on the attached page.

In the Specification

Column 6, line 60: Please change "flanges 18, 18" to --flanges 18, 18a--.

Column 7, line 37: Please change "FIGS. 1, 1b, 1b" to --FIGS. 1, 1a, 1b--.

Signed and Sealed this
Thirtieth Day of September, 2014

Michelle K. Lee

Michelle K. Lee
*Deputy Director of the United States Patent and Trademark Office*

(12) United States Patent
Smatloch et al.

(10) Patent No.: US 8,726,655 B2
(45) Date of Patent: May 20, 2014

(54) MODULAR EXHAUST GAS ASSEMBLY

(75) Inventors: Christian Smatloch, Paderborn (DE); Elmar Grussmann, Altenbeken (DE); Frank Arlt, Hövelhof (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 521 days.

(21) Appl. No.: 13/013,255

(22) Filed: Jan. 25, 2011

(65) Prior Publication Data

US 2012/0023928 A1 Feb. 2, 2012

(30) Foreign Application Priority Data

Jan. 25, 2010 (DE) ..... 10 2010 005 761

(51) Int. Cl.

| | |
|---|---|
| *F02D 23/00* | (2006.01) |
| *F04D 29/44* | (2006.01) |
| *F04D 29/54* | (2006.01) |
| *B21K 19/00* | (2006.01) |

(52) U.S. Cl.

USPC ..... 60/602; 415/204; 415/205; 415/912; 29/889.2

(58) Field of Classification Search

USPC ..... 415/204, 912

See application file for complete search history.

(56) References Cited

U.S. PATENT DOCUMENTS

| | | | | |
|---|---|---|---|---|
| 6,519,936 | B2 | 2/2003 | Smatloch et al. | |
| 6,687,996 | B2 | 2/2004 | Smatloch et al. | |
| 6,708,485 | B2 | 3/2004 | Hinder et al. | |
| 6,910,506 | B2 | 6/2005 | Gabriel et al. | |
| 7,185,490 | B2 | 3/2007 | Smatloch et al. | |
| 7,198,459 | B2 * | 4/2007 | Grussmann et al. | 415/135 |
| 7,581,563 | B2 | 9/2009 | Smatloch | |
| 7,946,116 | B2 * | 5/2011 | Sausse et al. | 60/602 |
| 8,382,429 | B2 * | 2/2013 | Grussmann et al. | 415/213.1 |
| 2005/0126163 | A1 * | 6/2005 | Bjornsson, Sr. | 60/323 |
| 2008/0202117 | A1 | 8/2008 | Leroy | |
| 2009/0188747 | A1 | 7/2009 | Smatloch et al. | |
| 2009/0288404 | A1 | 11/2009 | Lempa et al. | |
| 2010/0098533 | A1 * | 4/2010 | Grussmann et al. | 415/203 |

(Continued)

FOREIGN PATENT DOCUMENTS

| | | |
|---|---|---|
| DE | 100 22 052 A1 | 1/2001 |
| DE | 100 29 807 C1 | 3/2002 |

(Continued)

OTHER PUBLICATIONS

DE 10050158 A1 English Translation.*

*Primary Examiner* -- Thomas Denton
*Assistant Examiner* -- Jessica Kebea
(74) *Attorney, Agent, or Firm* -- Henry M Feiereisen LLC

(57) ABSTRACT

A modular exhaust gas assembly includes a turbocharger housing having an exhaust flange and a bearing flange receptacle, and a plurality of turbine scrolls of different sizes for selective installation into the turbocharger housing in dependence on a power of an engine. Each turbine scroll has an inlet zone and is connected to the bearing flange receptacle via a selected one of a plurality of different bearing flanges and to the exhaust flange via a selected one of a plurality of different exhaust links. The inlet zone of each turbine scroll is configured to complement a contour of an outlet zone of a standard manifold so that the turbine scrolls are selectively connectable via their inlet zone to the manifold to suit the engine power at hand.

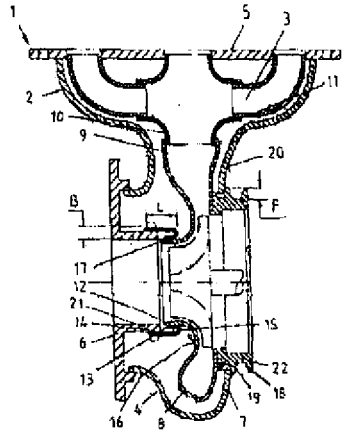

18 Claims, 3 Drawing Sheets